US005145725A

United States Patent [19]

Johnson et al.

[11] Patent Number: 5,145,725

[45] Date of Patent: Sep. 8, 1992

[54] DECORATIVE RIBBON AND METHOD OF MANUFACTURING SAME

[75] Inventors: R. Thurman Johnson, Blowing Rock; Hal G. Johnson, Boone, both of N.C.

[73] Assignee: Ribbon Textiles, Inc., Boone, N.C.

[21] Appl. No.: 660,700

[22] Filed: Feb. 25, 1991

[51] Int. Cl.[5] ..... D04D 9/00

[52] U.S. Cl. ..... 428/102; 156/93

[58] Field of Search ..... 428/4–5, 428/102; 156/91, 93

[56] References Cited

U.S. PATENT DOCUMENTS

| | | | |
|---|---|---|---|
| 4,366,199 | 12/1982 | Grosjean | 428/4 X |
| 4,585,676 | 4/1986 | DeSmet et al. | 428/5 |
| 4,634,612 | 1/1987 | Nelson et al. | 428/4 |
| 4,963,411 | 10/1990 | Protz, Jr. | 428/4 X |

*Primary Examiner*—Henry F. Epstein
*Attorney, Agent, or Firm*—W. Thad Adams, III

[57] ABSTRACT

A method of manufacturing a decorative ribbon, including the steps of gathering an elongate ribbon, stitching the ribbon along the length thereof while gathered to hold the ribbon in the gathered condition and heat setting the ribbon while held in the gathered condition by the stitches to permanently set the ribbon itself into the gathered condition. A variation in the appearance of the ribbon is achieved by winding the gathered ribbon onto a mandrel before heat setting the ribbon, heat setting the ribbon while the ribbon is wound onto the mandrel to place an axially repeating permanent twist into the ribbon, and removing the heat set ribbon from the mandrel.

20 Claims, 4 Drawing Sheets

DECORATIVE RIBBON AND METHOD OF MANUFACTURING SAME

TECHNICAL FIELD AND BACKGROUND OF THE INVENTION

This invention relates to a method of manufacturing a decorative ribbon or the like and a decorative ribbon product made according to the method. Ribbons made according to the method described in this application can be used for wrapping gift packages, making decorative bows and other trimming for packages and as hair accessories, trimming and otherwise decorating apparel, home furnishings and Christmas trees, other party and holiday decorations, and for many other purposes.

The term "ribbon" is used in this application in a broad sense to mean "a long narrow strip resembling a ribbon." See *Webster's Seventh New Collegiate Dictionary*, (G. & C. Merriam, 1972). The ribbon product described in this application may be fabricated of any long narrow strip material otherwise suitable for use, such as a woven ribbon material, slit films such as Mylar polyester film or lace. The ribbon material may be thermoplastic or coated with a heat setting resin.

Gathered decorative ribbons are known in the prior art. However, ribbons of the general type disclosed in this application have heretofore been gathered on a sewing machine and used in the gathered form without further processing. In such cases the gathering of the ribbon is maintained only by the gathering stitches themselves. When the stitches break or pull out the gathers release. The ribbon then ceases to present a pleasing decorative appearance and instead looks (and is) defective. Because of the ease with which the stitching pulls loose, products on which such prior art gathered ribbons are used should not be washed or subjected to hard use.

The invention described in this application provides an easy way of providing a decorative ribbon which is easy to use, can be washed repeatedly without losing the gathered appearance, and can be further processed to provide a much wider variety of appearances.

SUMMARY OF THE INVENTION

Therefore, it is an object of the invention to provide a method of manufacturing a decorative ribbon which has permanently set gathering.

It is another object of the invention to provide a method of manufacturing a decorative ribbon which maintains the gathered appearance even if the gathering stitches break or are removed.

It is another object of the invention to provide a method of manufacturing a decorative ribbon which can be gathered and otherwise processed to present many differing appearances held in place only by heat setting and without stitches.

It is another object of the invention to provide a method of manufacturing a decorative ribbon which results in a ribbon having permanent characteristics of many different varieties.

These and other objects of the present invention are achieved in the preferred embodiments disclosed below by providing a method of manufacturing a decorative ribbon, comprising the step of gathering an elongate ribbon, stitching the ribbon along the length thereof while gathered to hold the ribbon in the gathered condition and heat setting the ribbon while held in the gathered condition by the stitches to permanently set the ribbon itself into the gathered condition.

According to one preferred embodiment of the invention, the invention includes the steps of winding the gathered ribbon onto a mandrel before heat setting the ribbon, heat setting the ribbon while the ribbon is wound onto the mandrel to place an axially repeating permanent twist into the ribbon, and removing the heat set ribbon from the mandrel.

According to another preferred embodiment of the invention, the steps of gathering and stitching take place simultaneously as the ribbon is processed through a differential feed sewing machine.

According to yet another preferred embodiment of the invention, the stitching is applied along the center line of the ribbon generally equidistant two opposing side edges of the ribbon.

According to yet another preferred embodiment of the invention, the stitching is applied asymmetrically along the ribbon closer to one side edge than the other side edge.

According to yet another preferred embodiment of the invention, the ribbon is formed of a thermoplastic material.

According to yet another preferred embodiment of the invention, the ribbon is a woven fabric ribbon formed from a thermoplastic material.

According to yet another preferred embodiment of the invention, the ribbon is a slit film ribbon formed from a thermoplastic material.

According to yet another preferred embodiment of the invention, the ribbon comprises a lace ribbon formed from a thermoplastic material.

Preferably, the ribbon is gathered with a shirr ratio in the range of between 1.25 to 1 and 5 to 1.

According to another preferred embodiment of the invention, the ribbon is gathered with a shirr ratio in the range of between 2.5 to 1 and 10 to 1.

The product according to the invention results from the practice of the method.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
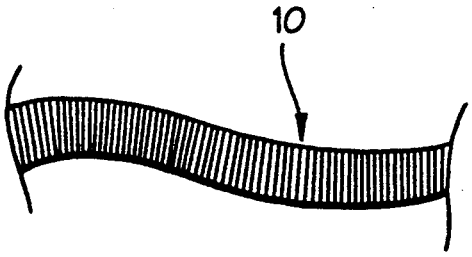
FIG. 1 shows a short section of a flat woven ribbon with which the method according to a preferred embodiment of the invention can be practiced and from which a product according to a preferred embodiment of the invention can be made.

Referring now specifically to the drawings, a woven flat ribbon material according to which the ribbon according to the present invention can be made is illustrated in FIG. 1 and shown generally at reference numeral 10. Ribbons made from grosgrain, satin weave material, printed or woven stripes, ribbons fabricated from non-woven strips and many other types of ribbons can also be used.

Preferably the ribbon is made from a thermoplastic material such as 100% polyester or nylon is used, which when deformed, heated above a certain temperature and cooled in the deformed position, permanently retains the deformed position. Alternatively, a ribbon which is not thermoplastic but which is coated or impregnated with a thermosetting resin may be used.

Figure 2:
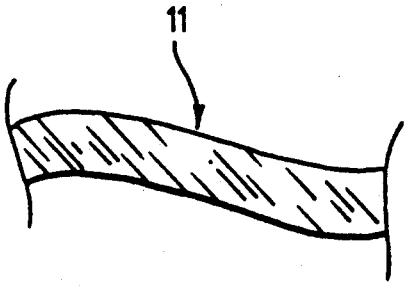
FIG. 2 shows a short section of a flat slit film with which the method according to a preferred embodiment of the invention can be practiced and from which a product according to another preferred embodiment of the invention can be made.

As is shown in FIG. 2, a slit polyester film ribbon 11 may also be used.

The ribbon according to the invention is constructed by first running the ribbon 10 or 11 through a sewing machine with a differential feed attachment. The sewing machine is set to a predetermined shirr ratio, meaning that the ribbon is gathered by feeding ribbon into the sewing machine at a given ratio faster than it is fed out of the sewing machine. If the ribbon is fed into the machine two and one-half times faster than it is fed out of the machine, the shirr ratio is "2.5 to 1" and the resulting gathered ribbon resembles the gathered ribbons 12, 13 and 14 shown in FIGS. 3, 4 and 5.

The stitches inserted by the sewing machine hold the gathers in place. If the stitching is removed, the length of the ungathered ribbon is two and one-half times longer than the gathered ribbon. Shirr ratios between 1.25 and 10 to are possible and will create different appearances in the gathered ribbon. The degree to which the ribbon can be gathered depends on the thickness and flexibility of the ribbon.

Figure 6:
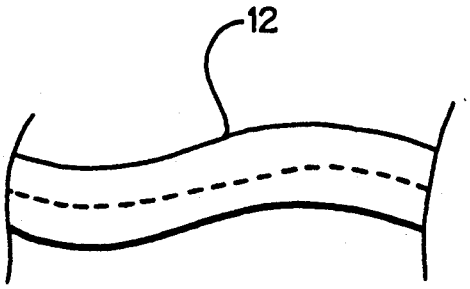
FIGS. 6, 7 and 8 show the stitching arrangement of three embodiments of the ribbon product, with the gathering omitted to show the stitching position along the centerline of the ribbon (FIG. 6), along one side edge of the ribbon (FIG. 7), and a centerline zig-zag stitch (FIG. 8)
Figure 7:
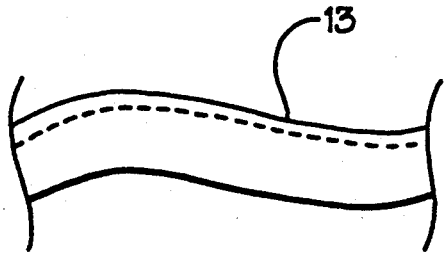
Figure 8:
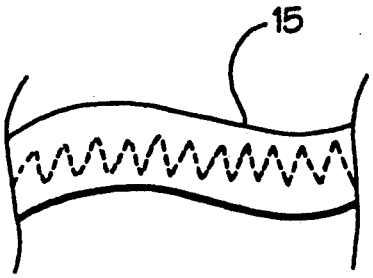
Figure 9:
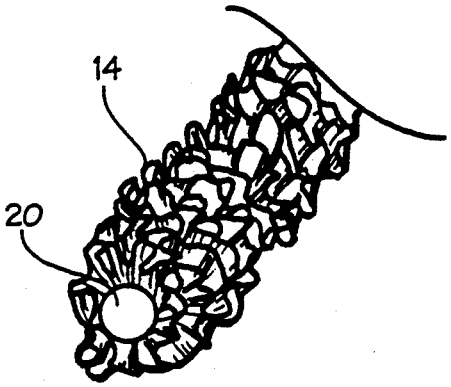
FIGS. 9, 10, 11 and 12 illustrate the step of wrapping the gathered ribbon before heat setting onto a mandrel according to varying shapes (cylindrical, oval, square and triangular, respectively, to set a longitudinally-extending twist into the gathered ribbon.
Figure 10:
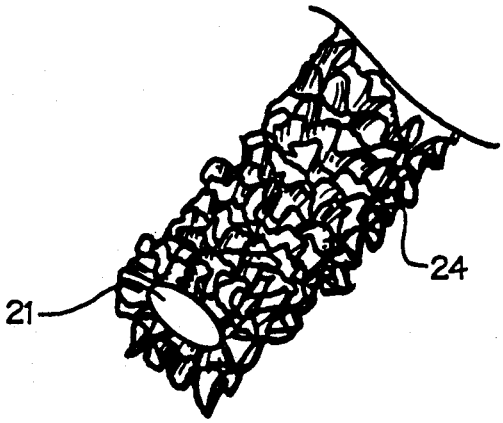
Figure 11:
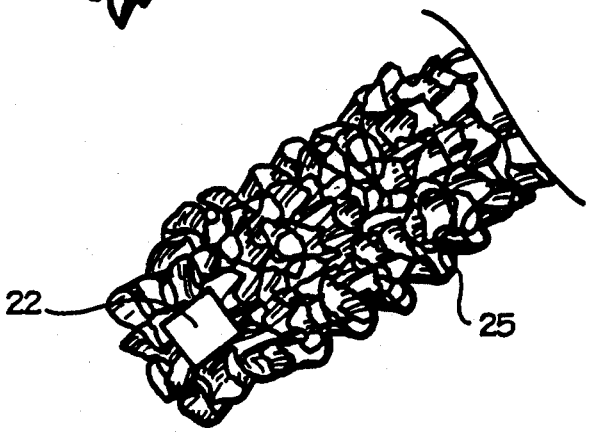
Figure 12:
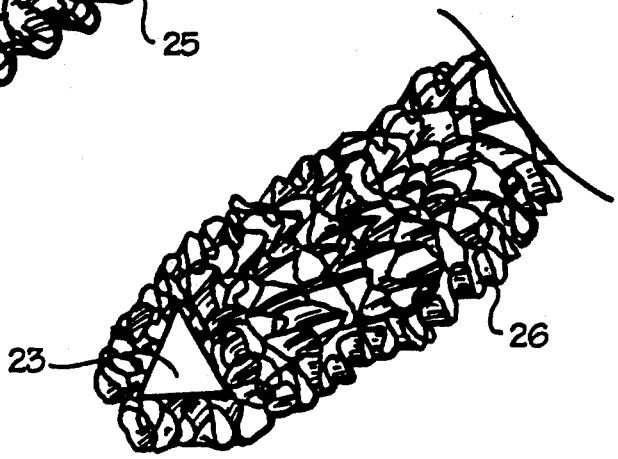

Different decorative effects can be achieved by varying the placement of the stitches. As is shown in FIG. 6, the stitches may be inserted down the centerline of the ribbon 12, giving the effect shown in FIG. 3. Placing the stitches asymmetrically along one side edge of the ribbon 13 as is shown in FIG. 7 will result in a different appearance with the gathered ribbon having broader, more fan-like gathers on one side as is shown in FIG. 4. Using zig-zag stitches on ribbon 15 as shown in FIG. 8 will result in a gathered ribbon having gathers of different depths. As noted above, the gathers have been removed from the ribbons shown in FIGS. 6, 7 and 8 in order to illustrate the stitching.

Many other variations in stitching can be used. The stitches per inch inserted into the ribbon have a substantial effect on the appearance of the ribbon. Different stitches such as straight, zig-zag, overedge seaming, smocking, shell, lock and chain stitches produce varying appearances, as does the use of two or more rows of parallel stitching.

After gathering the ribbon is arrayed onto a large tray or similar device and placed into a heat setting oven. The time and temperature are determined based on the type of material from which the ribbon is made and the dyestuff used to dye the ribbon. Th ribbon is heated to the point where the plastic memory of the thermoplastic ribbon is released. Then, the ribbon is cooled, resetting the plastic memory of the ribbon and the thermoplastic gathering thread in the gathered condition. If a ribbon with a thermosetting resin is used, the heat temperature and time is adjusted for the cure temperature and time of the resin. In either case, the resulting ribbon has a permanently set gather, so that even if the gathering thread or threads eventually break, the ribbon holds its shape. The ribbon may be washed repeatedly without losing its gathered appearance.

Figure 3:
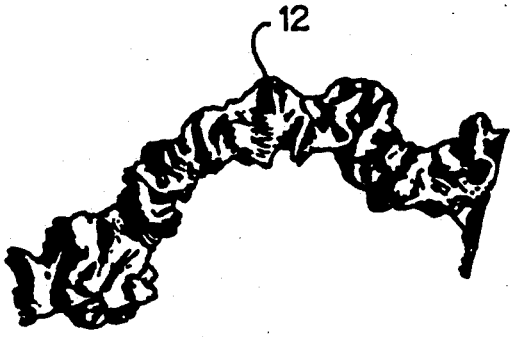
FIG. 3 shows the product according to one embodiment of the invention with a single row of gathering stitches along the centerline of the ribbon.
Figure 4:
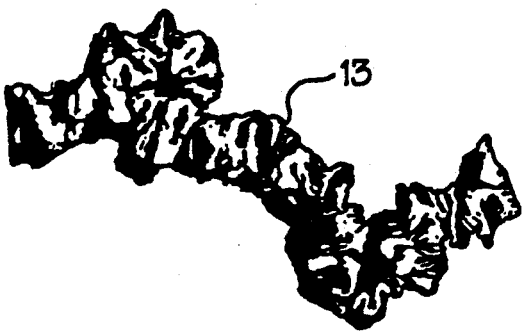
FIG. 4 shows the product according to another embodiment of the invention with a single row of gathering stitches along one side edge of the ribbon.

To produce a ribbon 12 or 13 such as shown in FIGS. 3 and 4, respectively, the heat set ribbon is then packaged according to preference by cutting to length, reeling onto a dispensing tube, packaging in bulk in bags or boxes or in other desired ways.

Figure 13:
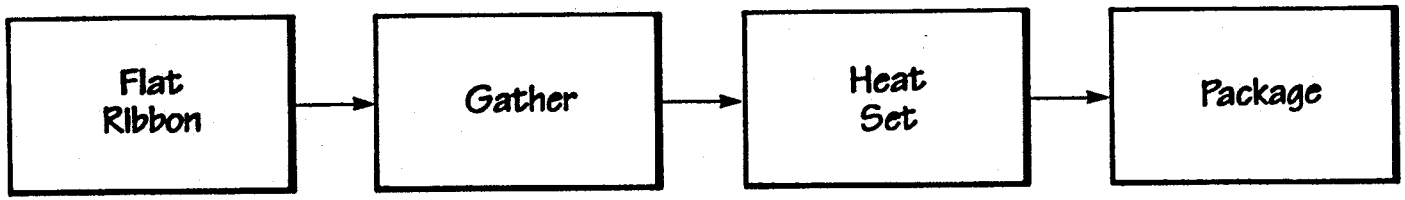
FIG. 13 is a flow diagram of the steps of the method according to one embodiment of the invention.

The method described above is illustrated in schematic form in FIG. 13.

Figure 5:
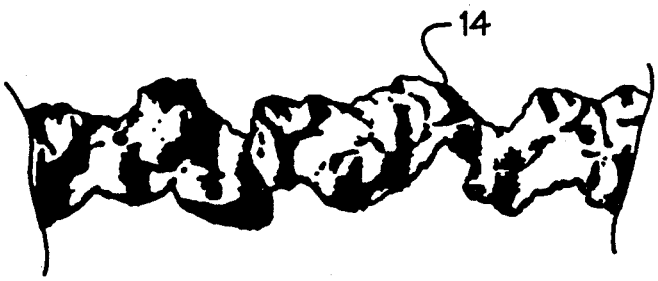
FIG. 5 shows the product according to another embodiment of the invention wherein the ribbon was wrapped around a cylindrical mandrel after gathering and before heat setting to impart a longitudinal, helical twist to the ribbon.

Further variations in the appearance of the ribbon may be achieved by introducing further random or repeating variations into the ribbon before heat setting. The ribbon shown in FIG. 5 illustrates the appearance of the ribbon shown in FIG. 3 if, before heat setting, the ribbon is wound around a cylindrical mandrel 20 to impart a spiral twist into the ribbon. The mandrel 20 with the ribbon 14 wound thereon is then placed into the heat setting oven as described above. After cooling, the ribbon 14 is removed from the mandrel 20. As shown in FIG. 5, the resulting product not only has permanently set gathers as in FIG. 3, but is additionally set into a permanent spiral, or helical, twist.

The ribbon 14 has a high degree of "spring" which permits the ribbon to be elongated and then released, whereupon the ribbon 14 returns to its relaxed length. Oval, square or triangular mandrels 21, 22, or 23 may also be used and result in ribbons 24, 25 or 26 as the case may be. In each case, the ribbons 24, 25 and 26 assume a springy, spiral configuration, but with a slightly different relaxed appearance. Wood, such as in the form of a dowel, makes a suitable mandrel.

The term mandrel is used in a broad sense to mean a support which holds the ribbon in a given shape and position during heating. Racks, frames and other structures could be also be used so long as a random or repeating arrangement of the ribbon is achieved and maintained during heat setting.

Figure 14:
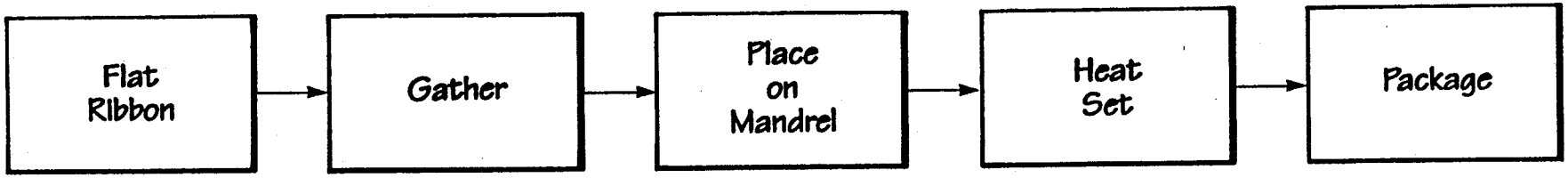
FIG. 14 is a flow diagram of the steps of the method according to another embodiment of the invention.

The method described immediately above is illustrated in schematic form in FIG. 14.

EXAMPLE

The ribbon material from which ribbon 12 was made is a ⅝" wide 100% polyester woven ribbon.

Ribbon 12 shown in FIG. 3 was made on a Model 400W31 sewing machine with a differential feed attachment feeding at a shirr ratio of 2.5 to 1. Twenty-four lock stitches per inch of monofilament nylon thread was used. Number 13 thread was used in the bobbin and number 17 thread in the needle. Machine rpm was set at between 3300 to 3500.

The gathered ribbon was arrayed on a large flat tray and placed in a walk-in heating oven at 350 for 20 minutes. Ribbons dyed with other dyestuffs may require heating up to 30 minutes. The range within which heat setting will ordinarily occur is between 10 and 30 minutes.

The ribbon 14 was placed on a ¼" diameter wooden dowel rod which served as the mandrel.

A method of manufacturing a decorative ribbon or the like and a decorative ribbon product made according to the method is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

We claim:

1. A method of manufacturing a decorative ribbon, comprising the step of:

(a) gathering an elongate ribbon;

(b) stitching the ribbon along the length thereof while gathered to hold the ribbon in the gathered condition; and (c) heat setting the ribbon while held in the gathered condition by the stitches to permanently set the ribbon itself into the gathered condition.

2. A method of manufacturing a ribbon according to claim 1, and including the steps of winding the gathered ribbon onto a mandrel before heat setting the ribbon; heat setting the ribbon while the ribbon is wound onto the mandrel to place an axially repeating permanent twist into the ribbon; and removing the heat set ribbon from the mandrel.

3. A method of manufacturing a ribbon according to claims 1 or 2, wherein the steps of gathering and stitching take place simultaneously as the ribbon is processed through a differential feed sewing machine.

4. A method of manufacturing a ribbon according to claim 3, wherein the stitching is applied along the center line of the ribbon generally equidistant opposing side edges of the ribbon.

5. A method of manufacturing a ribbon according to claim 3, wherein the stitching is applied asymmetrically along the ribbon closer to one side edge than the other side edge.

6. A method of manufacturing a ribbon according to claim 3, wherein the ribbon is formed of a thermoplastic material.

7. A method of manufacturing a ribbon according to claim 3, wherein the ribbon is a woven fabric ribbon formed from a thermoplastic material.

8. A method of manufacturing a ribbon according to claim 3, wherein the ribbon is a slit film ribbon formed from a thermoplastic material.

9. A method of manufacturing a ribbon according to claim 3, wherein the ribbon comprises a lace ribbon formed from a thermoplastic material.

10. A method of manufacturing a ribbon according to claim 3, wherein the ribbon is gathered with a shirr ratio in the range of between 1.25 to 1 and 5 to 1.

11. A method of manufacturing a ribbon according to claim 3, wherein the ribbon is gathered with a shirr ratio in the range of between 2.5 to 1 and 10 to 1.

12. A decorative ribbon, comprising an elongate gathered ribbon wherein the gathers of the ribbon are held in place by stitches applied to the ribbon while in its gathered condition and by heat setting the ribbon after stitching and while in a gathered condition to permanently set the ribbon into the gathered condition to thereby provide a decorative ribbon which will substantially retain the gathers even if the stitching is thereafter pulled loose or broken.

13. A decorative ribbon according to claim 12, wherein the stitching extends along the center line of the ribbon generally equidistant opposing side edges of the ribbon.

14. A decorative ribbon according to claim 12, wherein the stitching extends asymmetrically along the ribbon closer to one side edge than the other side edge.

15. A decorative ribbon according to claim 12, wherein the ribbon is formed of a thermoplastic material.

16. A decorative ribbon according to claim 12, wherein the ribbon is a woven fabric ribbon formed from a thermoplastic material.

17. A decorative ribbon according to claim 12, wherein the ribbon is a slit film ribbon formed from a thermoplastic material.

18. A decorative ribbon according to claim 12, wherein the ribbon comprises a lace ribbon formed from a thermoplastic material.

19. A decorative ribbon according to claim 12, wherein the ribbon is gathered with a shirr ratio in the range of between 1.25 to 1 and 5 to 1.

20. A decorative ribbon according to claim 12, wherein the ribbon is gathered with a shirr ratio in the range of between 2.5 to 1 and 10 to 1.

* * * * *